United States Patent [19]

Regan

[11] 4,185,228

[45] Jan. 22, 1980

[54] ELECTRODELESS LIGHT SOURCE WITH SELF-CONTAINED EXCITATION SOURCE

[75] Inventor: Robert J. Regan, Needham, Mass.

[73] Assignee: GTE Laboratories Incorporated, Waltham, Mass.

[21] Appl. No.: 952,765

[22] Filed: Oct. 19, 1978

[51] Int. Cl.[2] ..... H01J 65/00

[52] U.S. Cl. ..... 315/39; 315/248; 315/178; 315/150

[58] Field of Search ..... 315/39, 248, 267, 178

[56] References Cited

U.S. PATENT DOCUMENTS

| | | | |
|---|---|---|---|
| 3,942,058 | 3/1976 | Haugsjaa et al. | 315/248 X |
| 3,942,068 | 3/1976 | Haugsjaa et al. | 315/248 X |
| 3,943,401 | 3/1976 | Haugsjaa et al. | 315/248 X |
| 3,943,402 | 3/1976 | Haugsjaa et al. | 315/248 X |
| 3,943,403 | 3/1976 | Haugsjaa et al. | 315/248 X |
| 3,943,404 | 3/1976 | McNeill et al. | 315/39 |
| 3,993,927 | 11/1976 | Haugsjaa et al. | 315/39 |
| 3,995,195 | 11/1976 | Haugsjaa et al. | 315/248 X |
| 3,997,816 | 12/1976 | Haugsjaa et al. | 315/267 |
| 4,001,631 | 1/1977 | McNeill et al. | 315/39 |
| 4,001,632 | 1/1977 | Haugsjaa et al. | 315/39 |
| 4,002,944 | 1/1977 | McNeill et al. | 315/39 |
| 4,010,400 | 3/1977 | Hollister | 315/248 |
| 4,041,352 | 8/1977 | McNeill et al. | 315/248 |
| 4,053,814 | 10/1977 | Regan et al. | 315/248 |
| 4,063,132 | 12/1977 | Proud et al. | 315/248 |
| 4,065,701 | 12/1977 | Haugsjaa et al. | 315/248 |
| 4,070,603 | 1/1978 | Regan et al. | 315/248 |

*Primary Examiner*—Alfred E. Smith
*Assistant Examiner*—Charles F. Roberts
*Attorney, Agent, or Firm*—Fred Fisher; William R. McClellan

[57] ABSTRACT

An electrodeless light source having a termination fixture adapted for connection to a high frequency power source has an electrodeless lamp with a self-contained ultraviolet excitation source and a means for coupling power to the electrodeless lamp. The electrodeless lamp includes a main lamp cavity and an exciter lamp cavity within a single envelope. When power is applied to the fixture, the exciter lamp cavity emits ultraviolet radiation which assists starting of the arc discharge in the main lamp cavity.

16 Claims, 4 Drawing Figures

ELECTRODELESS LIGHT SOURCE WITH SELF-CONTAINED EXCITATION SOURCE

BACKGROUND OF THE INVENTION

This invention relates to electromagnetic discharge apparatus driven by high frequency power sources and more particularly to electrodeless light sources having an improved means for automatic starting.

Electrodeless light sources which operate by coupling high frequency power to an arc discharge in an electrodeless lamp have been developed. These light sources typically include a high frequency power source connected to a termination fixture with an inner conductor and an outer conductor disposed around the inner conductor. The electrodeless lamp is positioned at the end of the inner conductor. High frequency power is coupled to a light emitting electromagnetic discharge in the electrodeless lamp. A portion of the termination fixture passes radiation at visible light frequencies, thus permitting use of the apparatus as a light source.

The electrodeless lamp in its operating condition represents a relatively low impedance of approximately a few hundred ohms. However, in the off state the impedance of the lamp is high. Since the termination fixture is designed to effect an impedance match to the operating impedance of the lamp, thus obtaining maximum transfer of power from the source to the arc discharge, there exists in the off state a mismatch between the lamp and the high frequency power source. This off-state mismatch creates a problem in starting a discharge when power is first applied to the light source. Because of the mismatch, insufficient forward directed power is delivered to the lamp to cause starting. A tuning element located in the termination fixture is used for starting in U.S. Pat. No. 4,002,944 issued Jan. 11, 1977 to McNeill et al. A resonant condition is created which causes a strong electric field to initiate breakdown and excitation of the fill material within the lamp.

The use of ultraviolet light sources to start the discharge in electrodeless lamps is described in U.S. Pat. No. 3,997,816 issued Dec. 14, 1976 to Haugsjaa et al. An ultraviolet source is placed near the electrodeless lamp and provides free photoelectrons which, in combination with a high frequency electric field from the power source, induce starting of the electrodeless lamp. Either a glow lamp or a spark generating device is located in the space between the inner and outer conductors of the termination fixture. The glow lamp is series with a bimetallic switch is connected across the conductors of the termination fixture. When the electrodeless lamp heats up, the bimetallic switch opens and the glow lamp is turned off. A variation on this method of starting an electrodeless lamp is shown in U.S. Pat. No. 4,041,352 issued Aug. 9, 1977 to McNeill et al. The ultraviolet source is connected in series with the high frequency power source thus reducing the voltage supplied to the high frequency power source. After starting the electrodeless lamp, a bimetallic switch shorts out the ultraviolet source and provides full voltage to the high frequency power source. Another method for starting an electrodeless lamp is shown in U.S. Pat. No. 4,053,814 issued Oct. 11, 1977 to Regan et al. The ultraviolet source is connected in series with the high frequency power source. A control circuit utilizing a photosensitive resistor reduces the DC voltage to the ultraviolet source in a continuously varying manner as the electrodeless lamp increases its light output.

Lower DC input voltage to the high frequency power source during lamp starting as shown in the two previously mentioned patents results in lower power delivered to the electrodeless lamp, thereby reducing the voltage standing waves caused by a mismatched load. Excessive voltage standing waves could result in damage to the high frequency power source. A solid state microwave power source for use in an electrodeless lamp is described in U.S. Pat. No. 4,070,603 issued Jan. 24, 1978 to Regan et al. Better matching to the electrodeless lamp during starting is a feature of the power source. Thus, the possibility of damage to the power source during starting is reduced.

While the above-described methods for starting electrodeless light sources give generally satisfactory results, such techniques have certain disadvantages. Some of these disadvantages are circuit complexity which in turn reduces reliability, mechanical complexity of the termination fixture and the requirement for several manual operations to effectuate starting.

The following U.S. patents relate generally to electrodeless light sources and may be of interest.

| U.S. Pat. No. | Patentee | Issue Date |
|---|---|---|
| 3,942,058 | Haugsjaa et al | Mar. 2, 1976 |
| 3,942,068 | Haugsjaa et al | Mar. 2, 1976 |
| 3,943,401 | Haugsjaa et al | Mar. 9, 1976 |
| 3,943,402 | Haugsjaa et al | Mar. 9, 1976 |
| 3,943,403 | Haugsjaa et al | Mar. 9, 1976 |
| 3,943,404 | McNeill et al | Mar. 9, 1976 |
| 3,993,927 | Haugsjaa et al | Nov. 23, 1976 |
| 3,995,195 | Haugsjaa et al | Nov. 30, 1976 |
| 4,001,631 | McNeill et al | Jan. 4, 1977 |
| 4,001,632 | Haugsjaa et al | Jan. 4, 1977 |
| 4,010,400 | Hollister | Mar. 1, 1977 |
| 4,063,132 | Proud et al | Dec. 13, 1977 |
| 4,065,701 | Haugsjaa et al | Dec. 27, 1977 |

PRIOR ART STATEMENT

Pursuant to 37 CFR 1.97, the foregoing listed patents include, in the opinion of the applicant, the closest prior art of which he is aware. This statement should not be considered as a representation that a search has been made or that no better art exists.

Pursuant to 37 CFR 1.98, a concise explanation of the relevance of each listed patent is set forth hereinabove.

SUMMARY OF THE INVENTION

It is an object of the present invention to provide electrodeless light sources which have new and improved means for automatic starting.

It is another object of the present invention to provide electrodeless light sources which have ultraviolet excitation sources for lamp starting which are self-contained in the electrodeless lamp.

It is another object of the present invention to provide electrodeless light sources which have starting means which do not necessitate being switched out of the system after lamp starting.

It is yet another object of the present invention to provide electrodeless light sources which are simpler in construction, have fewer parts, and are easily manufactured.

According to the present invention, an electromagnetic discharge apparatus includes an electrodeless lamp having a generally cylindrical shaped envelope made of a light transmitting substance, a main lamp cavity, and an exciter lamp cavity. The main lamp cavity encloses a fill material which emits light upon breakdown and excitation. The exciter lamp cavity encloses a material which emits ultraviolet radiation upon breakdown and excitation. A termination fixture has an inner conductor and an outer conductor. The conductors have a first end adapted for coupling to a high frequency source and a second end coupled to the electrodeless lamp. A power coupling means electrically couples high frequency power from the second end of said inner conductor to the main lamp cavity and the exciter lamp cavity. The high frequency power, when coupled to the exciter lamp cavity, is sufficient to cause an ultraviolet glow discharge therein. The ultraviolet glow discharge and the high frequency power cause excitation of the main lamp cavity fill material.

In another embodiment of the invention, the electrodeless lamp includes a tubular stem for coupling to the second end of the inner conductor. The power coupling means includes a tubular capacitive coupling sleeve disposed around the cylindrical lamp stem for capacitive coupling of power from the inner conductor and an inductive coupling coil connected to the capacitive coupling sleeve and disposed around the electrodeless lamp for coupling of power to the main lamp and exciter lamp cavities.

In another embodiment of the present invention, the power coupling means includes a tubular capacitive coupling sleeve disposed around the lamp stem for capacitive coupling of power from the inner conductor, an inductive coupling coil disposed around the exciter lamp cavity for coupling power to said exciter lamp cavity, and a power coupling cylinder disposed around the space between the exciter lamp cavity and the main lamp cavity such that power will be coupled to said main lamp cavity. The capacitive coupling sleeve and the power coupling cylinder are connected by the inductive coupling coil to form a single conductor.

In another embodiment of the present invention, the exciter lamp cavity of the electrodeless lamp is toroidal in shape and the power coupling means passes axially through the exciter lamp cavity.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Electrodeless lamps, when operating, are matched in impedance by means of the termination fixture in which they are mounted so that virtually all high frequency input power is coupled to the arc discharge when the lamp is running. The electrodeless lamp in the arc discharge mode has a fairly low impedance. However, in the off state the electrodeless lamp has a high impedance and most of the high frequency power is reflected when power is initially applied. Since very little forward directed power is delivered to the electrodeless lamp upon application of power, a means of assisting the initiation of the discharge is required.

Starting of the electrodeless lamp occurs if ultraviolet radiation is applied to the electrodeless lamp simultaneously with a high frequency electric field. The present invention provides an ultraviolet source for lamp starting which is self-contained within the electrodeless lamp and which is powered by the same high frequency power source as the main lamp.

Figure 1:
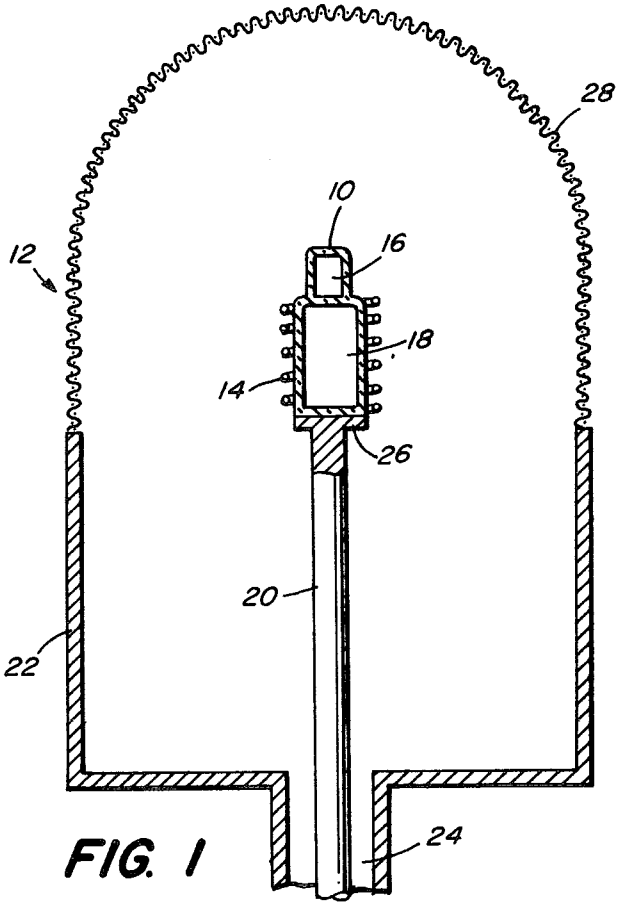
FIG. 1 is a diagram indicating an electrodeless light source with self-contained ultraviolet excitation source and power coupling means in accordance with the present invention.

In an exemplary embodiment of the invention, as shown in FIG. 1, an electromagnetic discharge apparatus, or more particularly an electrodeless light source, includes an electrodeless lamp 10, a termination fixture 12 adapted for coupling to a high frequency power source, and a power coupling means 14. As used in this disclosure, high frequency power source refers to power sources in the frequency range of 100 MHz to 300 GHz. Preferably, frequencies in the ISM band, ranging from 902 MHz to 928 MHz, are used.

The electrodeless lamp 10 is made from a light transmitting substance, preferably quartz, and includes within its envelope a main lamp cavity 16 and an exciter lamp cavity 18. Each cavity is surrounded by quartz material to form two enclosed volumes separated by a quartz barrier. The main lamp cavity 16 generates the useful light output during lamp operation and contains one of several known fill materials which produce a high pressure discharge upon breakdown and excitation. An example of a suitable fill material is 8.9 mg. of mercury, 1.5 mg. of $ScI_3$, 1.7 mg. NaI, and 20 torr of argon enclosed within a quartz sphere having a 15 mm. ID. The exciter lamp cavity fill material produces an ultraviolet glow discharge upon excitation by a high frequency electric field. The ultraviolet radiation passes through the quartz barrier to the main lamp cavity 16 and assists the starting of a discharge therein. The exciter lamp cavity fill material is preferably a Penning mixture such as one of argon and mercury. The electrodeless lamp 10 typically has a generally cylindrical shape with the main lamp cavity 16 and the exciter lamp cavity 18 typically located on the axis of the cylinder.

The termination fixture 12 has an inner conductor 20 and an outer conductor 22 disposed around the inner conductor 20. The conductors have a first end 24 adapted for coupling to a high frequency power source. Typically the coupling to the high frequency power source is by coaxial cable. Alternatively, the high frequency power source can be built into the electrodeless light source housing. In this configuration, standard 60 Hertz AC power can be supplied to the electrodeless light source. The electrodeless lamp 10 is located at the second end 26 of the inner conductor which can be adapted for mounting of the lamp.

In order that the apparatus be useful as a light source, at least a portion of the outer conductor 22 must be capable of transmitting light or, alternatively, the outer conductor 22 must have openings which will pass light. If the outer conductor has openings to pass light, such openings are preferably small in comparison with the wavelength of the high frequency input power to prevent emission of RFI (radio frequency interference). Typically a dome shaped element 28 made of a light transmitting substance and covered with a conductive mesh forms the second end of the outer conductor 22.

Power is coupled to the main lamp cavity 16 and the exciter lamp cavity 18 by the power coupling means 14 which is connected to the second end 26 of the inner conductor. The power coupling means 14 is adapted in the operating mode to couple virtually all high frequency power to the arc discharge in the main lamp cavity 16 and is normally a conductor. Typically the power coupling means 14 is an inductive coupling coil disposed around the electrodeless lamp 10. The inductive coupling coil may be a helix or a spiral or may have a variable number of turns per unit length. The coil surrounds the exciter lamp cavity 18 and has its last turn in proximity to the lower end of the main lamp cavity 16 so that optimum power coupling is achieved while at the same time light from the discharge is not blocked by the coil. Upon application of high frequency power, a strong electric field is set up in the main lamp cavity 16. Also an electric field is induced in the exciter lamp cavity 18 sufficient to cause an ultraviolet glow discharge. The ultraviolet radiation is emitted in all directions, but in particular passes to the main lamp cavity 16 to predispose free or relatively free charges upon the inner surface of the lamp or within the gas contained in the lamp cavity 16. At this stage the arc discharge has not started and the electrodeless lamp 10 is not matched in impedance to the high frequency power source. The strong electric field acting upon the free charges made available by the ultraviolet radiation is then sufficient to initiate a discharge in the main lamp cavity 16. Starting usually occurs in a matter of microseconds although full lamp output is not attained for several seconds. Initiation of an arc discharge causes the impedance of the main lamp cavity 16 to be lowered thus effecting a better impedance match and more of the high frequency power is absorbed by the discharge as the arc increases in intensity. The discharge in the exciter lamp cavity 18 is a glow discharge and has an impedance which is high in relation to the main lamp cavity 16 impedance when operating. Thus, a small fraction of the input power goes into the ultraviolet glow discharge and it is unimportant whether the ultraviolet discharge extinguishes or remains in the idle mode during lamp operation.

Figure 2:
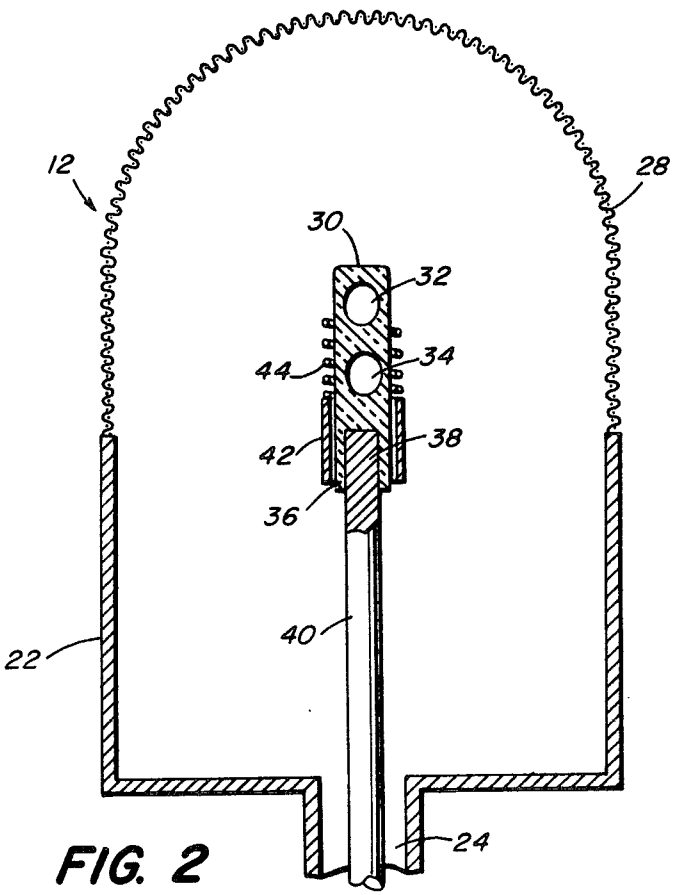
FIGS. 2, 3, and 4 are diagrams indicating electrodeless light sources, each with self-contained ultraviolet excitation source and power coupling means, in accordance with other embodiments of the present invention.

Another embodiment of the invention is shown in FIG. 2. The electrodeless lamp 30 includes a main lamp cavity 32 and an exciter lamp cavity 34 similar to those described above and also includes a tubular stem 36 which is open on its lower end. The inside diameter of the tubular stem 36 is slightly larger than the second end 38 of the inner conductor 40. The electrodeless lamp 30 is mounted by mating the tubular stem 36 to the second end 38 of the inner conductor 40. The power coupling means includes a capacitive coupling sleeve 42 and an inductive coupling coil 44 which are made of conductive material and are connected to form a single conductor. The capacitive coupling sleeve 42 is disposed around the tubular stem 36 of the electrodeless lamp 30. The inductive coupling coil 44 surrounds the exciter lamp cavity 34 and has its last turn in proximity to the lower end of the main lamp cavity 32. The inductive coupling coil 44 may be helical or spiral or may have a variable number of turns per unit length. High frequency power is capacitively coupled from the inner conductor 40 to the capacitive coupling sleeve 42. The inductive coupling coil 44 induces an electric field in the exciter lamp cavity 34 and the main lamp cavity 32. The electric field in the exciter lamp cavity 34 causes an ultraviolet glow discharge which in combination with the high electric field in the main lamp cavity 32 causes starting of an arc discharge in the main lamp cavity 32 as hereinbefore described.

Figure 3:
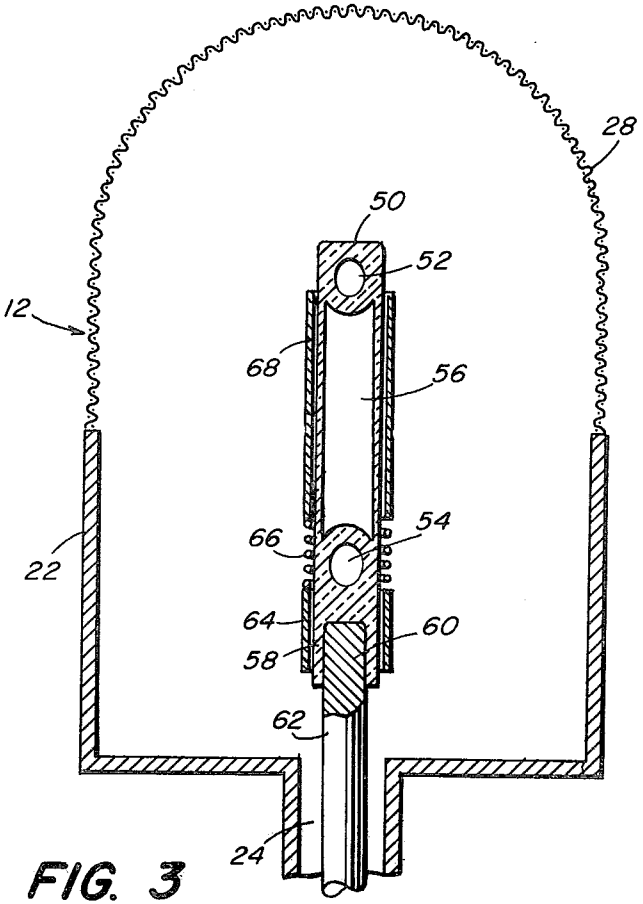

Another embodiment of the invention is shown in FIG. 3. The electrodeless lamp 50 includes a main lamp cavity 52 and an exciter lamp cavity 54. The space 56 between the exciter lamp cavity 54 and the main lamp cavity 52 may be air, quartz, or some other medium capable of transmitting ultraviolet radiation. One limitation on the distance between the main lamp cavity 52 and the exciter lamp cavity 54 is that sufficient ultraviolet radiation from the exciter lamp cavity 54 must impinge on the main lamp cavity 52 to cause starting of the arc discharge. The electrodeless lamp 50 further includes a tubular stem 58 which is open on its lower end. The inside diameter of the tubular stem 58 is slightly larger than the second end 60 of the inner conductor 62. The electrodeless lamp 50 is mounted by mating the tubular stem 58 to the second end 60 of the inner conductor 62.

The power coupling means includes a capacitive coupling sleeve 64, an inductive coupling coil 66, and a power coupling cylinder 68. The capacitive coupling sleeve 64 is disposed around the tubular stem 58 of the electrodeless lamp 50. The inductive coupling coil 66 surrounds the exciter lamp cavity 54 and is connected to the upper end of the capacitive coupling sleeve 64 and to the lower end of the power coupling cylinder 68 to form a single conductor. The space 56 between exciter lamp cavity 54 and the main lamp cavity 52 is surrounded by the power coupling cylinder 68. High frequency power is coupled from the inner conductor 62 by the capacitive coupling sleeve 64 and is coupled to the exciter lamp cavity 54 by the inductive coupling coil 66 and to the main lamp cavity 52 by the power coupling cylinder 68. A strong electric field exists at the upper end of the power coupling cylinder 68 in the main lamp cavity 52. The electric field in the exciter lamp cavity 54 causes an ultraviolet glow discharge which in combination with the high electric field in the main lamp cavity 52 causes starting of an arc discharge in the main lamp cavity 52 as hereinbefore described.

Figure 4:
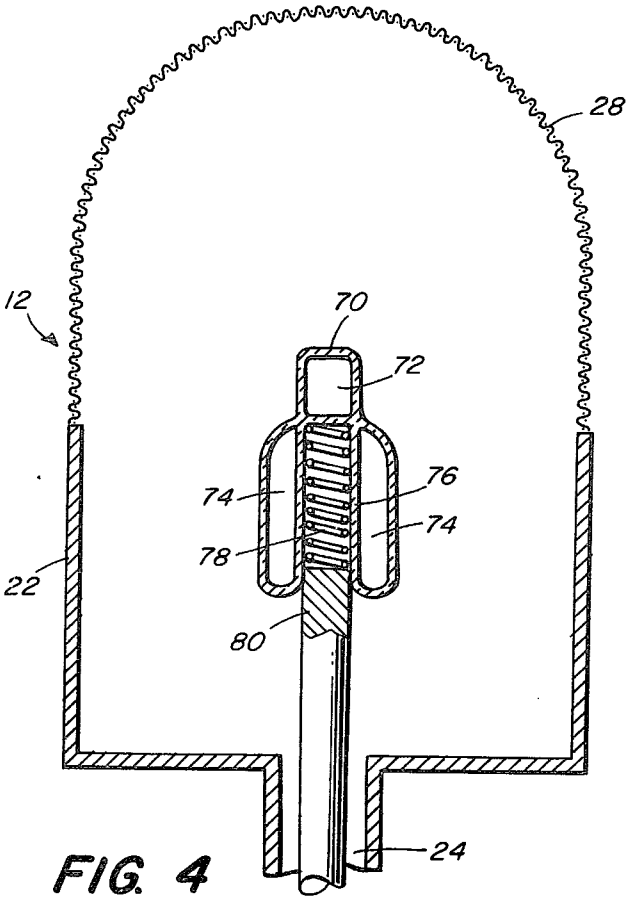

Another embodiment of the invention is shown in FIG. 4. The electrodeless lamp 70 includes a main lamp cavity 72 and an exciter lamp cavity 74 which is toroidal in shape and which has an opening 76 which extends through the center of the exciter lamp cavity 74 to the lower end of the main lamp cavity 72. The toroidal exciter lamp cavity 74 is an enclosed volume, typically a Penning mixture such as mercury and argon. The opening 76 in the center of the exciter lamp cavity 74 is an air space which is open on its lower end and which is dimensioned to accept the power coupling means 78. As described previously, the power coupling means 78 is typically a helical or spiral inductive coupling coil. It can be an integral part of the inner conductor 80 or can be a separate element coupled to the inner conductor 80. The toroidal shape permits the exciter lamp cavity 74 to have a relatively large volume as this is favorable for excitation of a Penning mixture. The close proximity of the upper end of the inductive coupling coil 78 to the main lamp cavity 72 results in a high electric field in the main lamp cavity 72. The electric field induced in the exciter lamp cavity 74 causes an ultraviolet glow discharge which in combination with the high electric field in the main lamp cavity 72 causes starting of an arc discharge in the main lamp cavity 72 as hereinbefore described.

The above described invention provides a means for automatic starting of an electrodeless light source without the requirement of additional elements to achieve starting. The only external action required to start the lamp is application of high frequency power, for example, by switching on the ac or dc power to the high frequency power source. Rather than utilizing a separate ultraviolet source placed between the inner conductor and the outer conductor with additional control elements and connections to a power source, the ultraviolet source is self-contained in the electrodeless lamp.

While there has been shown and described what is at present considered the preferred embodiments of the invention, it will be obvious to those skilled in the art that various changes and modifications may be made therein without departing from the scope of the invention as defined by the appended claims.

What is claimed is:

1. An electromagnetic discharge apparatus comprising an electrodeless lamp having an envelope made of a light transmitting substance, a main lamp cavity, and an exciter lamp cavity, said main lamp cavity enclosing a fill material which emits light upon breakdown and excitation and said exciter lamp cavity enclosing a material which emits ultraviolet radiation upon breakdown and excitation;

a termination fixture having an inner conductor and an outer conductor disposed around the inner conductor, the conductors having a first end adapted for coupling to a high frequency power source and a second end coupled to said electrodeless lamp; and a power coupling means for electrically coupling high frequency power from said second end of said inner conductor to said main lamp cavity and said exciter lamp cavity, said high frequency power when coupled to said exciter lamp cavity being sufficient to cause an ultraviolet glow discharge therein, and said ultraviolet glow discharge and said high frequency power causing excitation of said main lamp cavity fill material.

2. The electromagnetic discharge apparatus according to claim 1 wherein said power coupling means is a helical inductive coupling coil disposed around said electrodeless lamp and connected to the second end of said inner conductor.

3. The electromagnetic discharge apparatus according to claim 1 wherein said power coupling means is a spiral inductive coupling coil disposed around said electrodeless lamp and connected to the second end of said inner conductor.

4. The electromagnetic discharge apparatus according to claim 1 wherein said exciter lamp cavity of said electrodeless lamp contains a mixture of mercury and argon.

5. The electromagnetic discharge apparatus according to claim 1 wherein said electrodeless lamp includes a tubular stem for coupling to the second end of said inner conductor.

6. The electromagnetic discharge apparatus according to claim 5 wherein said power coupling means includes a tubular capacitive coupling sleeve disposed around said lamp stem for capacitive coupling of power from said inner conductor and an inductive coupling coil connected to said capacitive coupling sleeve and disposed around said electrodeless lamp for coupling of power to said main lamp cavity and said exciter lamp cavity.

7. The electromagnetic discharge apparatus according to claim 6 wherein said inductive coupling coil is a helix.

8. The electromagnetic discharge apparatus according to claim 5 wherein said power coupling means includes a tubular capacitive coupling sleeve disposed around said lamp stem for capacitive coupling of power from said inner conductor, an inductive coupling coil disposed around said exciter lamp cavity for coupling power to said exciter lamp cavity, and a power coupling cylinder disposed around the space between said exciter lamp cavity and said main lamp cavity such that power will be coupled to said main lamp cavity, said capacitive coupling sleeve and said power coupling cylinder being connected by said inductive coupling coil to form a single conductor.

9. The electromagnetic discharge apparatus according to claim 1 further including a source of power at high frequency coupled to the first end of said termination fixture.

10. The electromagnetic discharge apparatus according to claim 1 wherein the exciter lamp cavity of said electrodeless lamp is toroidal in shape and said power coupling means passes axially through said toroidal exciter lamp cavity.

11. An electromagnetic discharge apparatus comprising an electrodeless lamp having an envelope made of a light transmitting substance, a main lamp cavity, and an exciter lamp cavity, said main lamp cavity enclosing a fill material which emits light upon breakdown and excitation and said exciter lamp cavity enclosing a material which emits ultraviolet radiation upon breakdown and excitation; and a termination fixture having an inner conductor and an outer conductor disposed around the inner conductor, the conductors having a first end adapted for coupling to a high frequency power source and a second end adapted for coupling high frequency power to said main lamp cavity and said exciter lamp cavity, said high frequency power when coupled to said exciter lamp cavity being sufficient to cause an ultraviolet glow discharge therein, and said ultraviolet glow discharge and said high frequency power causing excitation of said main lamp cavity fill material.

12. The electromagnetic discharge apparatus according to claim 11 wherein said termination fixture includes a helical inductive coupling coil disposed around said electrodeless lamp for coupling high frequency power to said main lamp cavity and said exciter lamp cavity.

13. The electromagnetic discharge apparatus according to claim 11 wherein said termination fixture includes a spiral inductive coupling coil disposed around said electrodeless lamp for coupling high frequency power to said main lamp cavity and said exciter lamp cavity.

14. The electromagnetic discharge apparatus according to claim 11 wherein said exciter lamp cavity of said electrodeless lamp contains a mixture of mercury and argon.

15. The electromagnetic discharge apparatus according to claim 11 wherein the exciter lamp cavity of said electrodeless lamp is toroidal in shape and said second end of said inner conductor passes axially through said toroidal exciter lamp cavity.

16. The electromagnetic discharge apparatus according to claim 11 further including a source of power at high frequency coupled to the first end of said termination fixture.

* * * * *